US007686402B2

(12) United States Patent
Chabrier et al.

(10) Patent No.: US 7,686,402 B2
(45) Date of Patent: Mar. 30, 2010

(54) MACHINE FOR MACHINE WORKING THE GROUND

(75) Inventors: Jacky Chabrier, Ath (BE); Sylvain Gauthier, Ath (BE)

(73) Assignee: Husqvarna Belgium S.A., Ath (BE)

( * ) Notice: Subject to any disclaimer, the term of this patent is extended or adjusted under 35 U.S.C. 154(b) by 227 days.

(21) Appl. No.: 11/765,506

(22) Filed: Jun. 20, 2007

(65) Prior Publication Data

US 2008/0067857 A1 Mar. 20, 2008

(30) Foreign Application Priority Data

Jun. 20, 2006 (EP) ..... 06291039

(51) Int. Cl.
*E01C 19/00* (2006.01)

(52) U.S. Cl. ..... 299/39.3; 299/39.6

(58) Field of Classification Search ..... 299/39.3, 299/39.6

See application file for complete search history.

(56) References Cited

U.S. PATENT DOCUMENTS 3,357,745 A * 12/1967 Cooper ..... 299/39.3
4,953,523 A * 9/1990 Swan ..... 299/39.3
6,926,261 B1 * 8/2005 Renshaw ..... 254/420

* cited by examiner

*Primary Examiner*—John Kreck
(74) *Attorney, Agent, or Firm*—Lowe Hauptman Ham & Berner LLP

(57) ABSTRACT

The invention concerns a ground-machining machine (100) comprising:

a secondary chassis (104) able to move in translation with respect to the ground (118);

a main chassis (106) carrying a machining device (110) and able to move with respect to the secondary chassis (104) between an idle position and a machining position and vice versa;

a maneuvering mast (102) integral with the said secondary chassis (104) and extending along a principal axis (160) substantially vertical with respect to the ground (118), the said maneuvering mast (102) comprising driving means (134) for moving the main chassis (106) from the said idle position to the said machining position and vice versa;

an actuation means (120) mounted on a top plate (622) disposed at the top of the said maneuvering mast (102), the said actuation means (120) allowing actuation of the said driving means (134) by a user;

the ground-machining machine (100) being such that the maneuvering mast (102) and the said driving means (134) are adapted to allow the adjustment for height of the said actuation means (120) along the said principal axis (160).

17 Claims, 8 Drawing Sheets

MACHINE FOR MACHINE WORKING THE GROUND

RELATED APPLICATION

The present application is based on, and claims priority from, FR Application Number 06290039.3, filed Jun. 20, 2006, the disclosure of which is hereby incorporated by reference herein in its entirety.

The invention concerns a ground-machining machine. It finds an application in the field of working on the ground, roads or concrete slabs or the like.

The expression "ground-machining machine" must be understood as including any machine for working on or machining the ground, such as for example a ground saw, a concrete plane, or the like.

The following description is particularly based on a ground saw, but can apply in the same way to all machines foe machining the ground.

In the following description, the position references top and bottom, front and rear, for example, will be made with respect to a ground saw in the operating position.

A ground saw is known comprising a secondary chassis resting on the ground by means of wheels and which is able to move by running on the ground. The ground saw also comprises a main chassis supporting a circular saw and which is able to move between an idle position and a sawing position and vice versa by rotation with respect to the secondary chassis. The circular saw saws the ground when the main chassis is in the sawing position.

A maneuvering chassis fixed to the secondary chassis extends substantially vertically with respect to the ground and comprises in its top part a wheel that controls the movement of the main chassis through driving means that allow passage from the idle position to the sawing position or vice versa.

At the top of the maneuvering chassis there are also disposed handles that enable the user to maneuver the ground saw. These handles are fixed to the maneuvering chassis by means of nut and screw systems that allow a slight movement of the handles in order to enable a potential user to adapt the position of the handles to his build.

Because of its construction, the ground saw allows adjustment of the handles to the build of each of the potential users, but it is not possible to adapt the height of the wheel to each of them, which gives rise to inconvenience in the use of the ground saw.

An object of the present invention is to propose a ground-machining machine that does not have the drawbacks of the ground-machining machines of the prior art and that makes it possible to adjust the height of the wheel according to the build of the user.

To this end, a ground-machining machine is proposed comprising:

- a secondary chassis able to move in translation with respect to the ground;
- a main chassis carrying a machining device and able to move with respect to the secondary chassis between an idle position and a machining position and vice versa;
- a maneuvering mast integral with the said secondary chassis and extending along a principal axis substantially vertical with respect to the ground, the said maneuvering mast comprising driving means for moving the main chassis from the said idle position to the said machining position and vice versa;

- an actuation means mounted on a top plate disposed at the top of the said maneuvering mast, the said actuation means allowing actuation of the said driving means by a user;

the ground-machining machine being such that the maneuvering mast and the said driving means are adapted to allow the adjustment for height of the said actuation means along the said principal axis.

Accordingly to a particular embodiment, the maneuvering mast consists of a bottom tube integral with the secondary chassis and a top tube integral with the said top plate and able to move with respect to the said bottom tube.

Advantageously, the bottom tube and the top tube are mounted telescopically with respect to each other.

According to a particular embodiment, the driving means comprise;

- a shaft integral with the said actuation means and extending along the said principal axis;
- an interface locked in translation with respect to the said bottom tube and free to rotate around the said principal axis, the said interface comprising on the one hand sliding means that cooperate with the said shaft in order to produce between them a sliding connection and on the other hand a first means forming a thread;
- a second means locked in rotation and forming a thread that cooperates with that of the first means in order to drive the said second means in translation;
- a bottom plate integral with the said second means and F with a driving stud;
- at least one arm, one of the ends of which is mounted so as to be free to rotate on the said driving stud and the other end of which is mounted so as to be free to rotate on the main chassis.

According to a particular embodiment, the bottom tube comprises an aperture through which the said driving stud passes.

According to a particular embodiment, the said aperture has an oblong shape whose axis is parallel to the said principal axis.

According to a particular embodiment, the shaft comprises an internal recess whose dimensions are at least greater than the dimensions of the said second means.

Advantageously, the ground-machining machine comprises means of locking the top tube with respect to the bottom tube.

According to a particular embodiment, the ground-machining machine comprises handles integral with the maneuvering mast.

Advantageously, the said handles are mounted on the said maneuvering mast by means of an angular and/or lateral adjustment device.

The characteristics of the invention mention above, as well as others, will emerge more clearly from a reading of the following description of an example embodiment, the said description being given in relation to the accompanying drawings, among which:

FIG. 1 depicts a ground-machining machine of the ground saw type 100 comprising:

Figure 1:
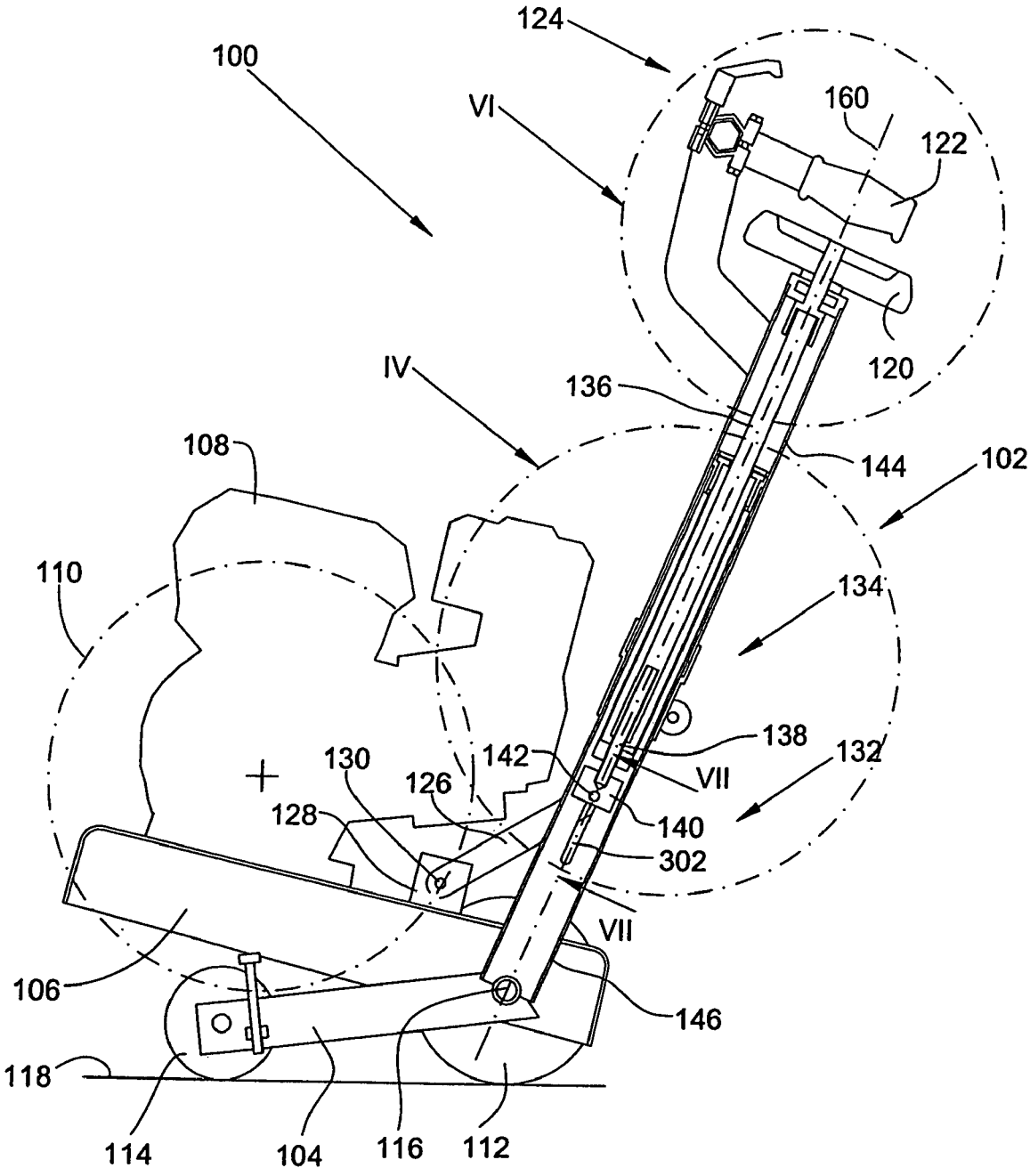
FIG. 1 depicts a vertical section of a ground saw according to an embodiment of the invention when the handles and wheel are lowered and the circular saw raised.

a secondary chassis 104;

a main chassis 106;

a maneuvering mast 102; and an actuation means 120.

The secondary chassis 104 is mounted on a set of wheels, generally four. Two wheels 114 are mounted at the front of the secondary chassis 104 and two wheels 112 are mounted at the rear of the same chassis. The secondary chassis 104 can thus be moved in translation by running on the ground 118.

The main chassis 106 carries a motor 108 that carries and drives a machining device of the circular saw type 110 (shown here in dot and dash lines). The main chassis 106 is able to move in rotation with respect to the secondary chassis 104 between an idle position, shown in FIG. 1, and a machining position, in particular sawing, shown in FIG. 3, and vice versa. The rotation axis 116 of the main chassis 106 is, in the embodiment in FIG. 1, merged with the rotation axis of the rear wheels 112.

The maneuvering mast 102 is integral with the secondary chassis 104 and extends along a principal axis 160, which is substantially vertical with respect to the ground 118. This maneuvering mast 102 receives control elements that are necessary for a potential user to be able to maneuver the ground saw 100. In particular, the maneuvering mast comprises driving means 134 for moving the main chassis 106 from the idle position to the sawing position and vice versa. In the embodiment of the invention shown in FIG. 1, the rotation axis 116 of the main chassis 106 and the rotation axis of the rear wheels 112 are concurrent with the principal axis 160. The maneuvering mast 102 is adapted to allow the adjustment for height of the actuation means 120 along the principal axis 160.

The actuation means 120, which here takes the form of a wheel, is mounted on a top plate 622 (FIG. 6) that is disposed at the top of the maneuvering mast 102. The actuation means 120 enables the user to actuate the driving means 134 and thus to make the main chassis 106 pass from the idle position to the sawing position and vice versa.

The driving means 134, the functioning of which is described below, allow the change in position of the main chassis 106, but are also adapted to allow the adjustment for height of the actuation means 120 along the principal axis 160.

This particular arrangement thus makes it possible to be able to adapt the height of the control elements fixed to the maneuvering mast 102, in particular that of the actuation means 120, according to the build of each potential user. The fact that the maneuvering mast 102 is integral with the secondary chassis 104 also guarantees that the passage from the idle position to the sawing position and vice versa does not give rise to any modification with regard to the height of the control elements and in particular that of the actuation means 120.

In a particular embodiment, the maneuvering mast 102 consists of a bottom tube 146 integral with the secondary chassis 104 and a top tube 144 integral with the top plate 622. The bottom tube 146 is thus immobile while the top tube 144 can move in translation along the principal axis 160 with respect to the bottom tube 146.

Advantageously, the adjustment of the actuation means 120 is guided by a telescopic mounting of the bottom tube 146 with respect to the top tube 144.

Figure 4:
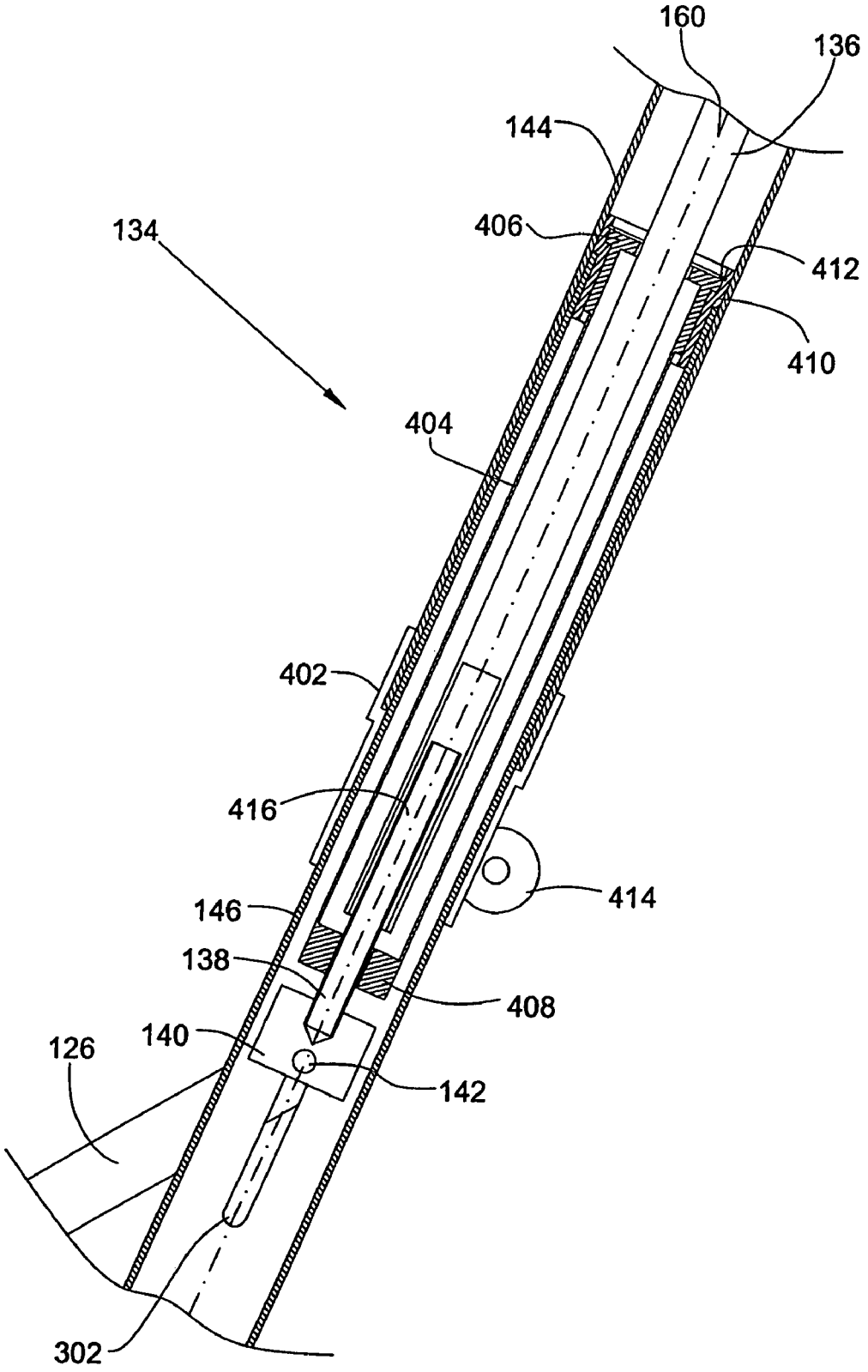
FIG. 4 depicts an enlargement of the detail IV in FIG. 1.

FIG. 4 depicts an enlargement of the junction zone between the bottom tube 146 and the top tube 144. The top tube 144 is integral with a locking sleeve 402, on which two eyes 414 are mounted. The locking sleeve 402, whose shape matches that of the bottom tube 146, extends radially over practically the whole of the perimeter of the bottom tube 146. The locking sleeve 402 has the shape of a tubular arc, each of whose ends is provided with an eye 414 so that the two eyes 414 are in opposition when the top tube 144 and the bottom tube 146 are assembled. A nut and screw system can them be put in place in the eyes 414 and the clamping of this system causes the clamping of the locking sleeve 402 on the bottom tube 146 and thus the locking in translation of the top tube 144 with respect to the bottom tube 146. In the embodiment described here, the locking sleeve 402, the eyes 414 and the nut and screw system constitute means of locking the top tube 144 with respect to the bottom tube 146.

In another embodiment of the invention, the means of locking the top tube 144 with respect to the bottom tube 146 can consists of a cam device, or a pin, or the like.

FIG. 4 also shows an enlargement of the driving means 134 of FIG. 1.

The driving means 134 comprise:

a shaft 136;

an interface 134 comprising a first means 408 forming a thread;

a second means 134;

a bottom plate 140;

a driving stud 142; and at least one arm 126.

The shaft 136 extends along the principal axis 160 and one of its ends is integral with the actuation means 120.

The interface 404 is locked in translation with respect to the bottom tube 146 and is free to rotate about the principal axis 160. The locking in translation and the freedom to rotate are provided by the fitting of a circlip 412, which jams a shoulder of the interface 404 against a shoulder of a stop sleeve 410 rigidly connected to the top end of the bottom tube 146. The interface 404 also comprises, at one of these ends, sliding means 406 which cooperate with the shaft 136 in order to produce between them a sliding connection. The sliding means 406 can for example take the form of a ring whose central bore has the shape of a right-angled prism. The shaft 136 then has the same cross section as that of the bore and thus forms a right-angled prism along the principal axis 160.

In the embodiment of the invention presented in the various figures, the interface 404 has the general shape of a cylinder whose axis is merged with the principal axis 160.

The first means 408 is preferably disposed at the other end of the interface 404 and here takes the form of a nut whose axis is merged with the principal axis 160.

The second means 138, also forming a thread, is locked with respect to rotation and can move only in translation parallel to the principal axis 160. This movement in translation is achieved by the cooperation between the thread of the second means 138 and the thread of the first means 408. The second means 138 here takes the form of a threaded rod.

The bottom plate 140 is integral with the second means 138 and is forced to move solely in translation along the principal axis 160, for example, either because of its shape in the bottom tube 146 or because of the existence of an aperture 302 whose function will be described below. The bottom plate 140 is also integral with the driving stud 142, which extends orthogonal to the principal axis 160.

Each arm 126 is mounted between the driving stud 142 and the main chassis 106. More precisely, one of the ends of each arm 126 is mounted so as to be free to rotate on the driving stud 142 and the other end of each arm 126 is mounted so as to be free to rotate on the main chassis 106. In the embodiment in FIG. 1, the mounting on the main chassis 106 is effected by means of a shaft 130 mounted on a protrusion 128 on the main chassis 106. The protrusion is disposed in front of the rotation axis 116 of the main chassis. Each arm 126 therefore extends towards the front of the rotation axis 116.

In the embodiment of the invention depicted in FIG. 1 the elements constituting the driving means 134 are disposed inside the maneuvering mast 102, with the exception of the arm or arms 126.

Figure 7:
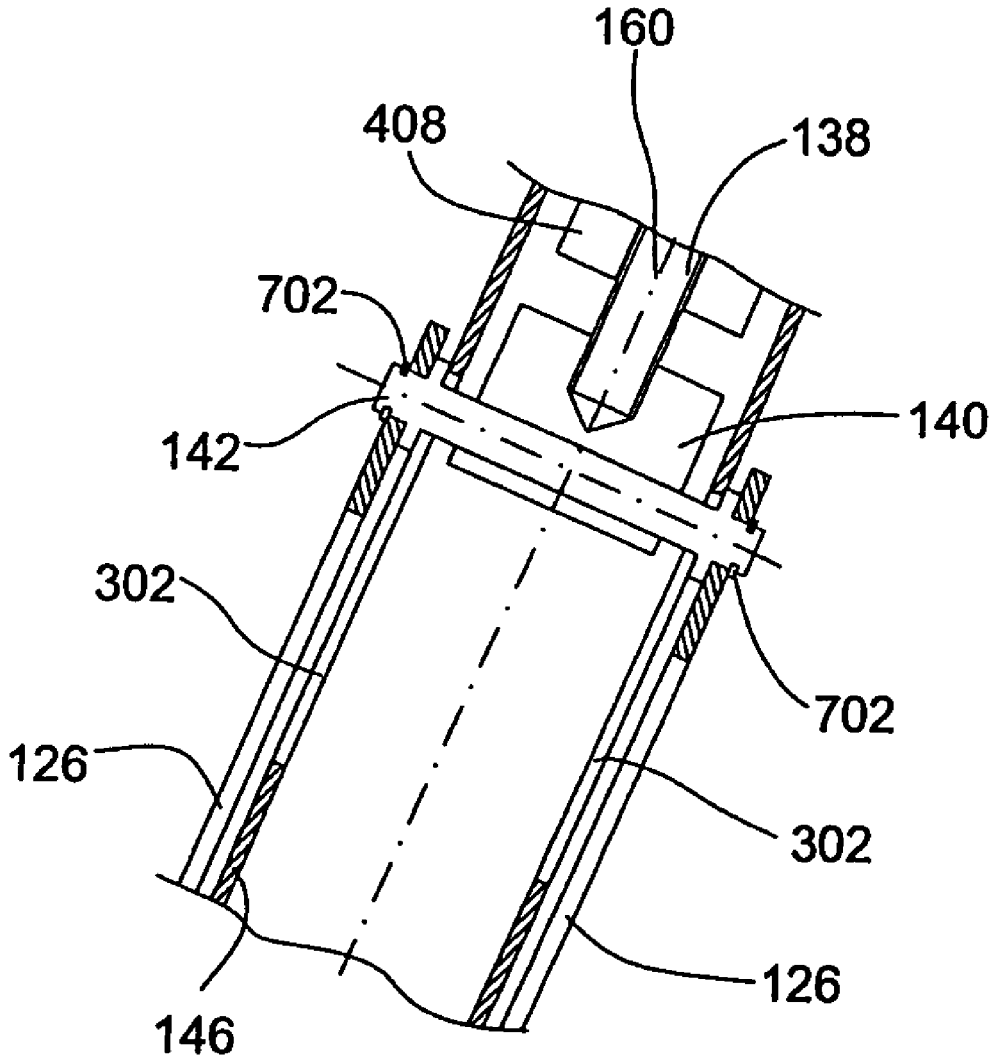
FIG. 7 depicts a section along the line VII-VII in FIG. 3.

FIG. 7 depicts a cross section of the maneuvering mast 102 level with the bottom plate 140. There is found there, inside the bottom tube 146, the bottom plate 140 and the driving stud 142 and, outside the bottom tube 146, two arms 126.

The driving stud 142 projects on each side of the bottom tube 146 through the apertures 302 produced in the wall of the bottom tube 146. In the case where there is only one arm 126, the driving stud 142 will project on only one side of the bottom tube 146 and a single aperture 302 will be sufficient. An arm 126 is held on the driving stud 142 by the sandwiching of this arm 126 between a shoulder produced on the driving stud 142 and a circlip 702.

Figure 3:
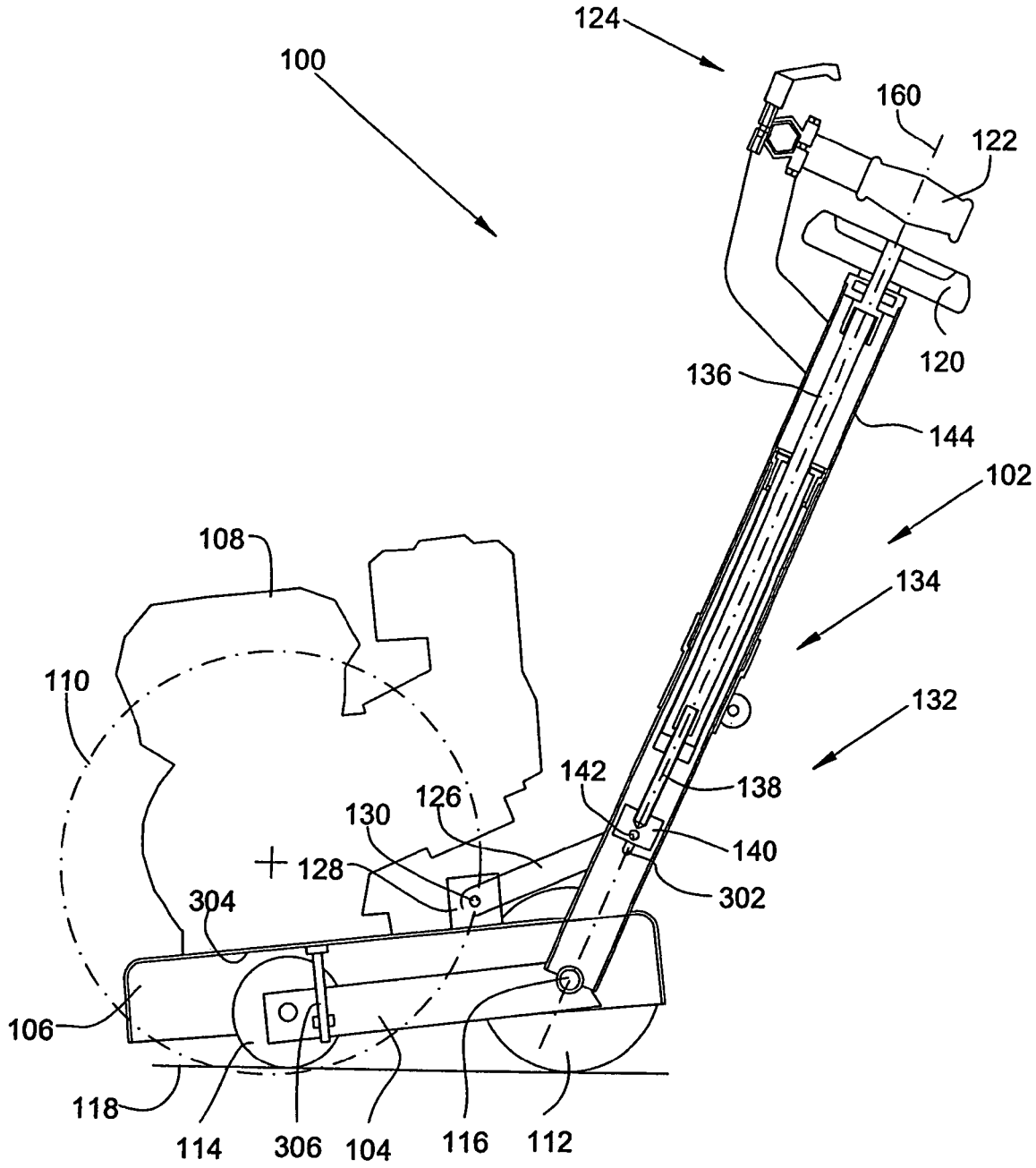
FIG. 3 depicts a vertical section of a ground saw similar to that of FIG. 1 when the circular saw is lowered.

To best guide the driving stud 142 in its movements, the aperture 302, which is seen better in FIG. 3, has an oblong shape whose axis is parallel to the principal axis 160. The dimensions of the aperture 302 are such that the fit between the aperture 302 and the driving stub 142 is a tight sliding fit.

Figure 2:
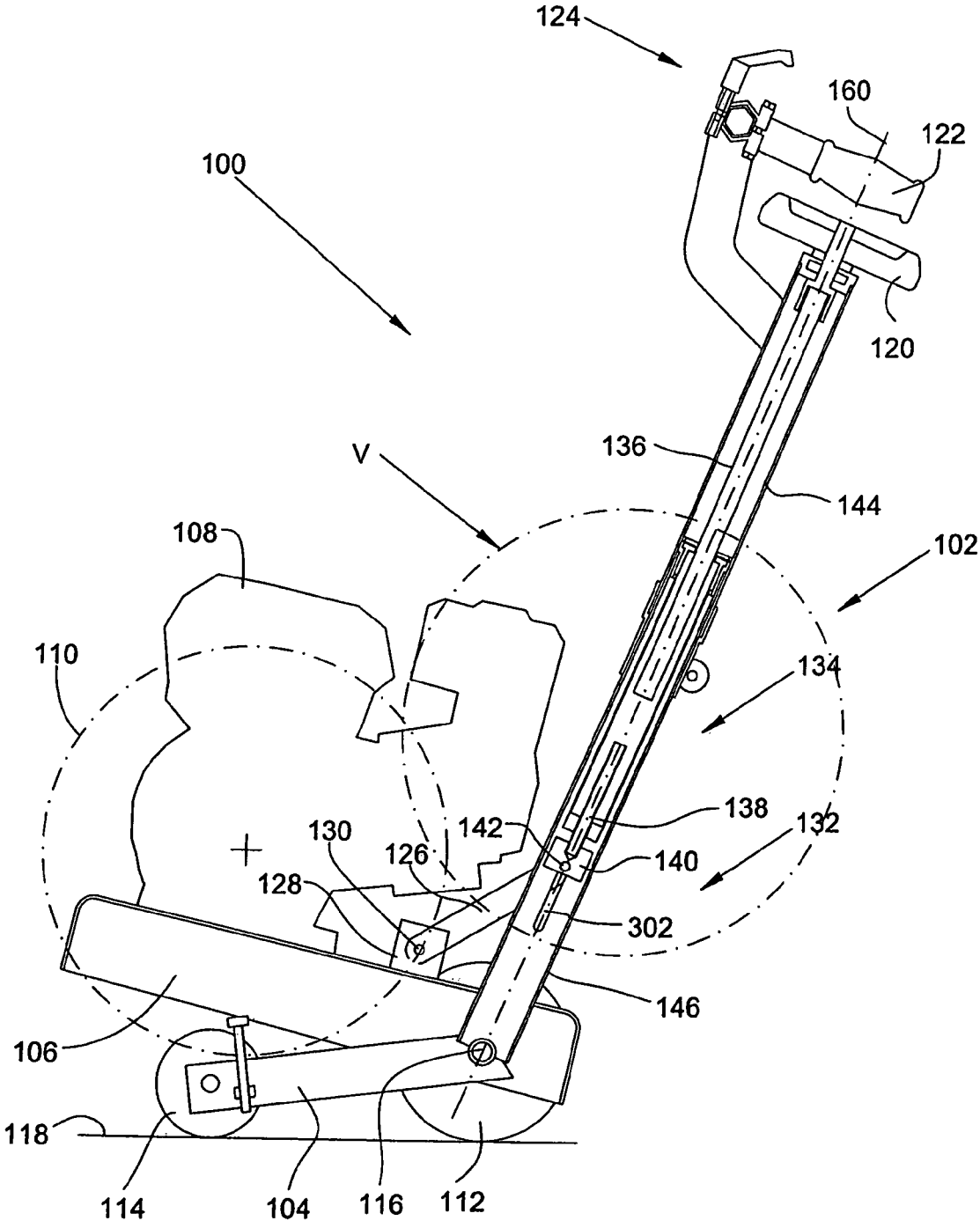
FIG. 2 depicts a vertical section of a ground saw according to the invention when the handles and wheel are raised and the circular saw raised.
Figure 5:
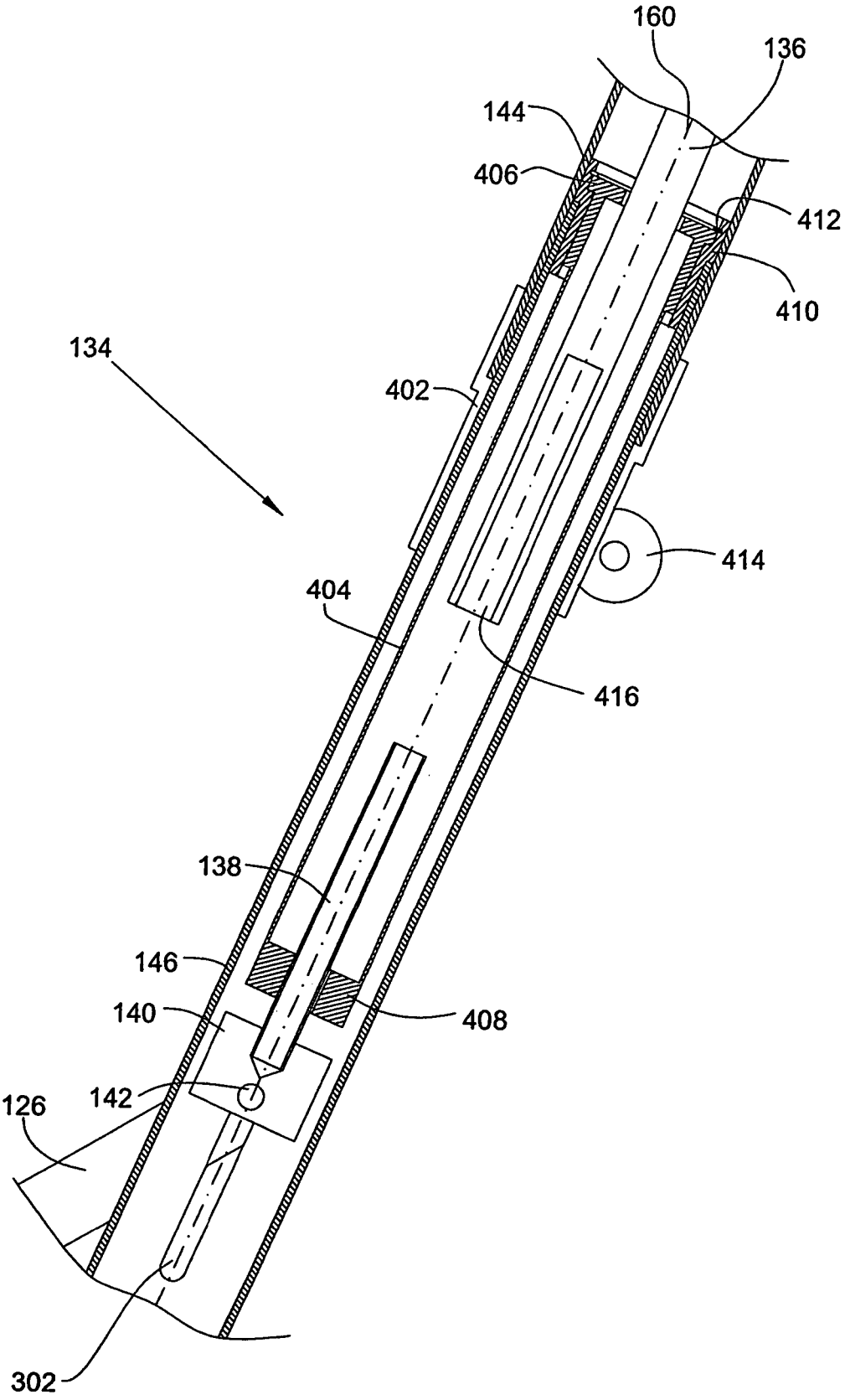
FIG. 5 depicts an enlargement of the detail V in FIG. 2.

The principle of the adjustment of the height of the actuation means 120 will now be described with the help of FIGS. 1, 2, 4 and 5. FIG. 1 shows the ground saw 100 when the actuation means 120 is in the low position and FIG. 2 shows the ground saw 100 when the actuation means 120 is in the high position. FIG. 4 shows an enlargement of the driving means 134 in the position of FIG. 1 and FIG. 5 depicts an enlargement of the driving means 134 in the position of FIG. 2.

A user who wishes to adjust the height of the actuation means 120 starting from the low position in order to arrive at the high position must first of all slacken the locking sleeve 402, which has the effect of releasing the translation movement between the bottom tube 146 and the top tube 144. The user can them move the top tube 144 so that the actuation means 120 reaches the desired position, for example the position in FIG. 5, and then, by retightening the locking sleeve 402, the bottom tube 146 and the top tube 144 are once again connected and fixed with respect to each other.

The shaft 136 being integral with the actuation means 120, the movement of the latter causes the movement of the shaft 136, which is not interfered with in its movement by the interface 404 because of the existence of a sliding connection between the latter and the shaft 136. Thus the shaft 136 slides on the interface 404 at the sliding means 406 of the interface 404. The movement of the actuation means 120 can therefore be very great along the length of the shaft 136 and, as explained below, the functioning of the ground saw 100 is guaranteed as long as the shaft 136 cooperated with the sliding means 406 of the interface 404.

During the adjustment of the height of the actuation means 120, each of the other elements constituting the driving means 134 remains in its initial position.

The passage of the actuation means 120 from a high position to a low position is effected in the same way except that it is necessary to lower the top tube 144 instead of raising it.

The principle of passing from the idle position to the sawing position will now be described with the help of FIGS. 1 and 3. FIG. 3 shows the same ground saw 100 as the one in FIG. 1 but in the sawing position, as to say in a position where the circular saw 110 is lowered in order to come into contact with the ground 118 to be cut.

In the case where the actuation means 120 is a wheel whose rotation axis is merged with the main axis 160, the rotation of the wheel 120 drives the shaft 136 in rotation, because these two elements are integral. Through the cooperation between the shaft 136 and the sliding means 406 of the interface 404, the latter is also driven in rotation about the principal axis 160 and, consequently, the first means 408 also turns. The latter rotation and the fact that the second means, 138 cannot turn means that the latter moves in translation along the principal axis 160. The downward movement of the second means 138, and therefore of the bottom plate 140, and of the driving shaft 142 that is integral with it, causes the downward movement of the end of each arm 126 connected to the driving shaft 142. This movement releases the main chassis 106, which is then driven in rotation about its rotation axis 116 under the effect of its own weight or under the effect of the thrust of each arm 126. This rotation brings the main chassis to the sawing position shown in FIG. 3.

The raising of the main chassis 106 to the idle position takes place in the reverse manner, by raising the end of each arm 126 and pulling on the main chassis 106.

As can be seen in FIG. 4 the shaft 134 and the second means 138 occupy a common space and, to prevent them coming into contact, the shaft 136 is hollow and thus comprised an internal recess 416, the dimensions of which are at least greater than the dimensions of the second means 138, that is to say than the diameter when the second means 138 takes the form of a threaded rod.

Figure 6:
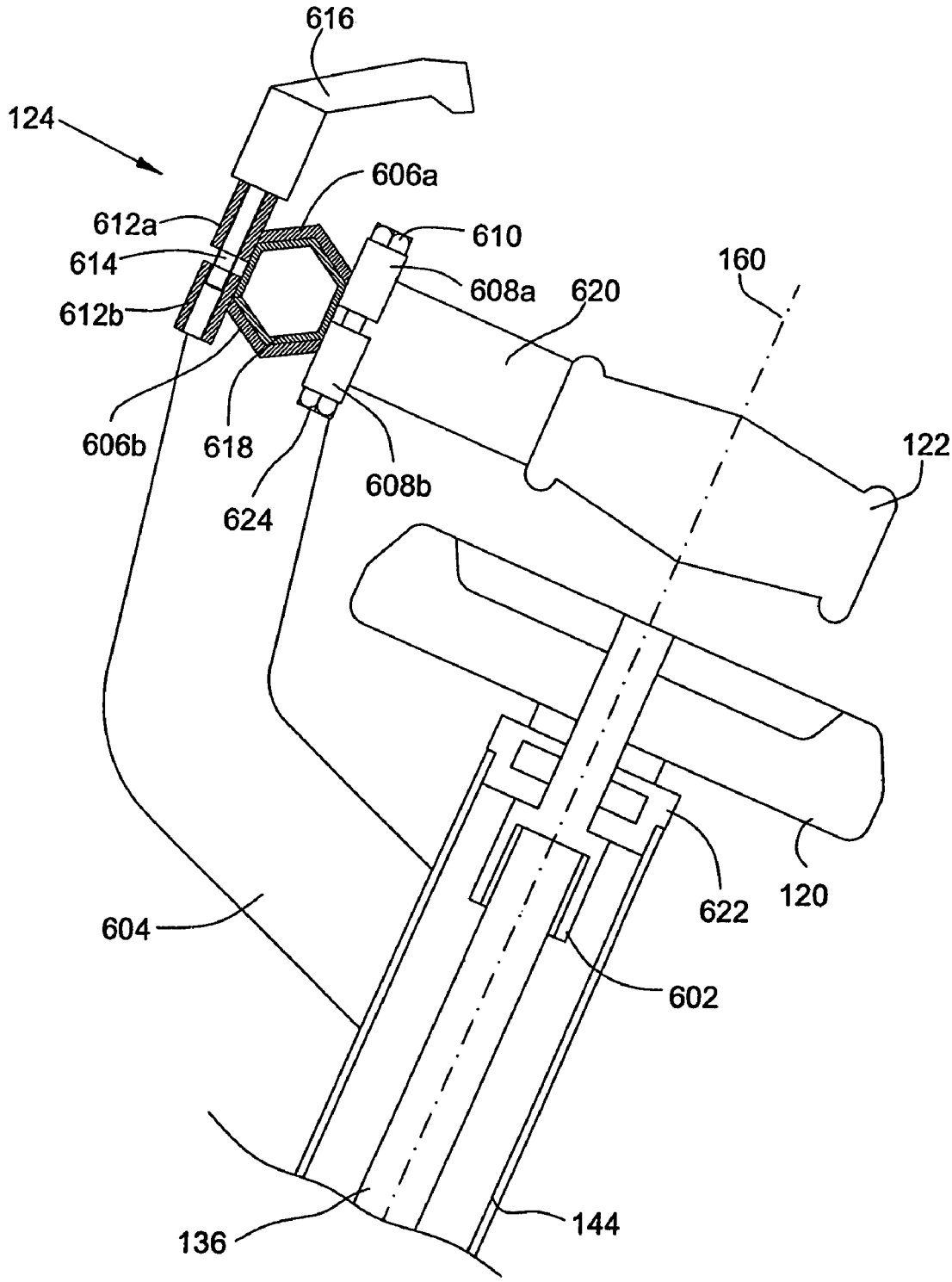
FIG. 6 depicts an enlargement of the detail VI in FIG. 1.

FIG. 6 depicts the top of the maneuvering mast 102, to which the actuation means 120 is fixed. Two handles 122 are provided to enable the user to direct the ground saw 100.

Each handle 122 comprises a shaft 620 that is fixed to a bracket 604 itself fixed to the top tube 144. This arrangement makes it possible to adjust the height of the handles 122 at the same time as the height of the actuation means 120. Each handle 122 is thus integral with the maneuvering mast 102.

To refine the position of the handles 122, and in particular their angular and/or lateral positioning with respect to the top tube 144, an angular and/or lateral adjustment device 124 can be provided between the handles 122 and the top tube 144.

This angular and/or lateral adjustment device 124 comprises two jaws 606*a* and 606*b*, a first device for fixing the jaws 606*a*, 606*b* to each other and a second device for fixing the jaws 606*a*, 606*b* to each other.

The first device for fixing the jaws 606*a* and 606*b* comprises two cylinders 608*a* and 608*b*, a screw 610 and a nut 624. Each cylinder 608*a* and respectively 608*b* is integral with one of the jaws 606*a* and respectively 606*b*. The screw 610 passes through the two cylinders 608*a* and 608*b* and the nut clamps them against the head of the screw 610.

The second device for fixing the jaws 606*a*, 606*b* comprises two cylinders 612*a* and 612*b* and a screw 614. Each cylinder 612*a* and respectively 612*b* is integral with one of the jaws 606*a* and respectively 606*b*. The screw 614 passes freely through the first cylinder 612*a* and is screwed inside the second cylinder 612*b*, which is, for this purpose, provided with a thread. To assist in the manipulation of this screw 614, a tightening handle 616 is provided.

The jaws 606*a* and 606*b* grip a tube 618, each end of which is fixed to the shaft 620 of one of the handles 122. The first fixing device and the second fixing device are disposed on each side of the tube 618. When the handles 122 are mounted, the tube 618 is introduced between the jaws 606*a* and 606*b* and the first fixing device and second fixing device are tightened.

To adjust the angular position of the handles 122 the user slackens the screw 614 provided with the clamping handle 616 and then positions the handles 122 according to his choice by rotation about the axis of the tube 618 and then retightens the screw 614 provided with the tightening handle 616.

The lateral adjustment of the handles 122 requires the length of the jaws 606*a* and 606*b* to be less than the length of the tube 618. Thus a movement parallel to the axis of the tube 618 is possible when the screw 614 is slackened.

Each jaw 606*a*, 606*b* here takes the form of a portion of a hexagon in order to assist the holding in position of the tube 618, which also takes the form of a hexagon, and therefore of the handles 122 when the jaws 606*a* and 606*b* are tightened. Naturally the jaws 606*a* and 606*b* and the tube 618 can take other forms complementary to each other and preferably comprising sharp edges in order to ensure the rotational locking of the handles 122 in the jaws 606*a* and 606*b*.

The top tube 144 and the bottom tube 146 are shown as having a circular cross section, but they may have a square, rectangular, oval or other cross section. In particular, the top tube 144 and the bottom tube 146 can take forms such that the handles 122 can be positioned at the front or rear of the principal axis 160. Such forms (oval, rectangular) are not circular but are symmetrical with respect to a plane containing the principal axis 160 and parallel to the rotation axis 116 of the main chassis 106.

Figure 8:
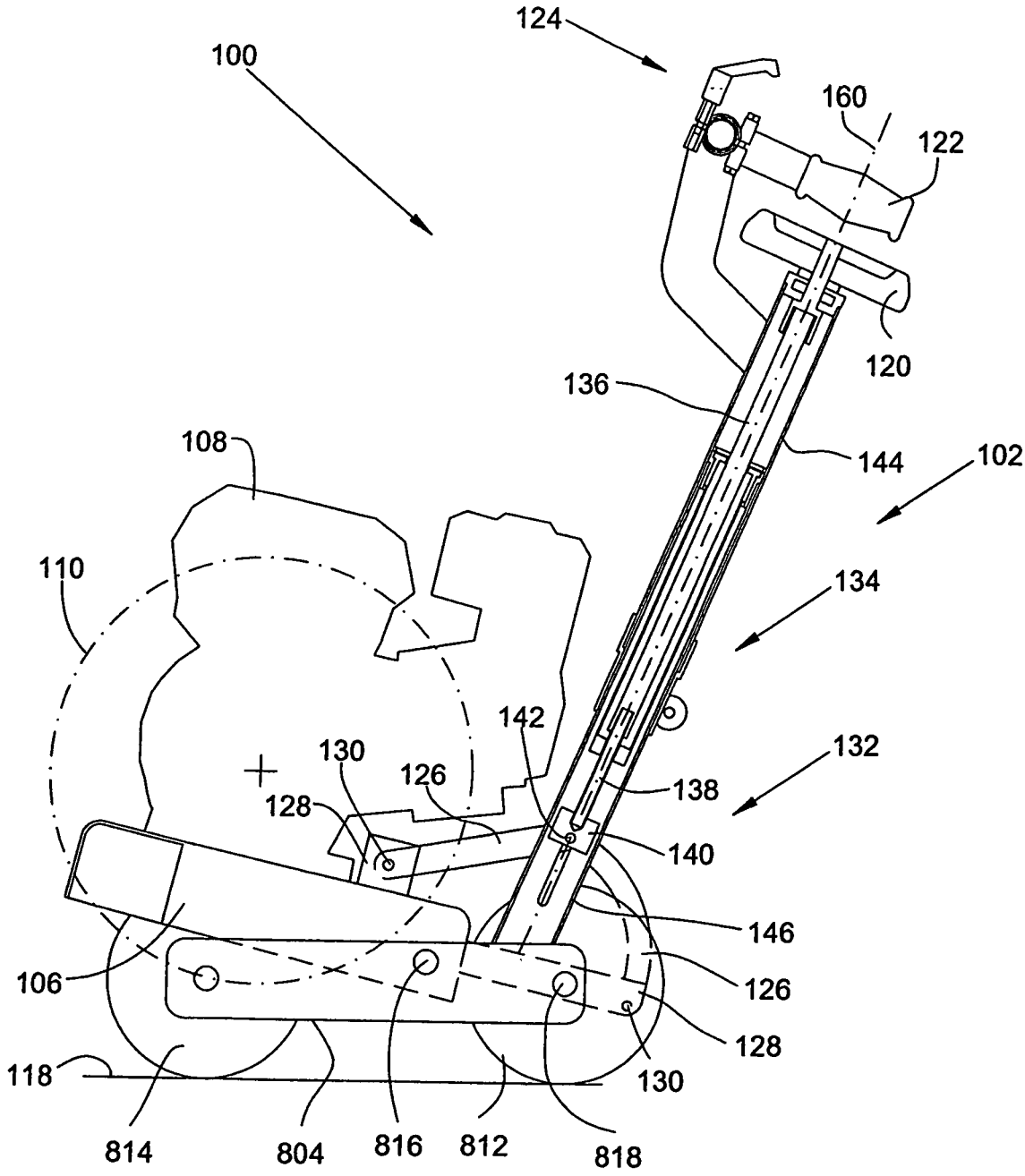
FIG. 8 depicts a vertical section of a ground saw according to another embodiment of the invention.

FIG. 8 shows a second embodiment of the invention in which the elements common to the first embodiment in FIGS. 1 to 3 bear the same references.

The ground saw 100 comprises a secondary chassis 804 able to move in translation with respect to the ground 118 on which it rests by means of front wheels 814 and rear wheels 812;

- a main chassis 106 carrying the circular saw 110 and able to move in rotation with respect to the secondary chassis 804 between an idle position and a sawing position and vice versa;
- a maneuvering mast 102 integral with the secondary chassis 804 and extending along a substantially vertical principal axis 160, the maneuvering mast 102 comprising the driving means 134 for moving the main chassis 106 from the said idle position to the said sawing position and vice versa;
- the actuation means 120 mounted on the top plate 622 disposed at the top of the maneuvering mast 102, the actuation means 120 allowing the actuation of the said driving means 134 by a user;

the ground saw 100 being such that the driving means 134 are also adapted to allow the adjustment for height of the actuation means 120 along the said principal axis 160.

Unlike the first embodiment, the axis 816, which is the rotation axis of the main chassis 106, and the axis 818, which is the rotation axis of the rear wheels 812, are not merged. In addition, neither of these axes 816 and 818 is concurrent with the principal axis 160.

Naturally the present invention is not limited to the examples and embodiments described and depicted, but is open to many variants accessible to persons skilled in the art.

For example, the invention is more particularly described in the case where the arms that maneuver the main chassis are disposed in front of the rotation axis of the main chassis but it is possible for the arms to be disposed behind the rotation axis of the main chassis. In this case the lowering of the main chassis is due to a raising of the bottom plate and its raising to a lowering of the bottom plate.

For example, the main chassis is more particularly described as being able to move in rotation with respect to the secondary chassis, but it may be able to move in translation.

The invention claimed is:

1. Ground-machining machine comprising: a secondary chassis able to move in translation with respect to the ground; a main chassis carrying a machining device and able to move with respect to the secondary chassis between an idle position and a machining position and vice versa; a maneuvering mast integral with the said secondary chassis and extending along a principal axis substantially vertical with respect to the ground, the said maneuvering mast comprising driving means for moving the main chassis from the said idle position to the said machining position and vice versa; an actuation means mounted on a top plate disposed at the top of the said maneuvering mast, the said actuation means allowing actuation of the said driving means by a user; the maneuvering mast and the said driving means comprising a height adjuster for adjusting the height of said actuation means along the said principal axis.

2. Ground-machining machine according to claim 1, wherein the maneuvering mast consists of a bottom tube integral with the secondary chassis and a top tube integral with the said top plate and able to move with respect to the said bottom tube.

3. Ground-machining machine according to claim 2, wherein the bottom tube and the top tube are mounted telescopically with respect to each other.

4. Ground-machining machine according to claim 2, wherein the driving means comprise: a shaft integral with the said actuation means and extending along the said principal axis; an interface locked in translation with respect to the said bottom tube and free to rotate around the said principal axis, the said interface comprising on the one hand sliding means that cooperate with the said shaft in order to produce between them a sliding connection and on the other hand a first means forming a thread; a second means locked in rotation and forming a thread that cooperates with that of the first means in order to drive the said second means in translation; a bottom plate integral with the said second means and with a driving stud; at least one arm, one of the ends of which is mounted so as to be free to rotate on the said driving stud and the other end of which is mounted so as to be free to rotate on the main chassis.

5. Ground-machining machine according to claim 4, wherein the bottom tube comprises an aperture through which the said driving stud passes.

6. Ground-machining machine according to claim 5, wherein the said aperture has an oblong shape whose axis is parallel to the said principal axis.

7. Ground-machining machine according to claim 4, wherein the shaft comprises an internal recess whose dimensions are at least greater than the dimensions of the said second means.

8. Ground-machining machine according to claim 2, wherein the ground-machining machine comprises means of locking the top tube with respect to the bottom tube.

9. Ground-machining machine according to claim 1, wherein the ground-machining machine comprises handles integral with the maneuvering mast.

10. Ground-machining machine according to claim 9, wherein the said handles are mounted on the said maneuvering mast by means of an angular and/or lateral adjustment device.

11. Ground-machining machine comprising: a secondary chassis able to move in translation with respect to the ground; a main chassis carrying a machining device and able to move with respect to the secondary chassis between an idle position and a machining position and vice versa; a maneuvering mast integral with the said secondary chassis and extending along a principal axis substantially vertical with respect to the ground, the said maneuvering mast comprising driving means for moving the main chassis from the said idle position to the said machining position and vice versa; an actuation means mounted on a top plate disposed at the top of the said maneuvering mast, the said actuation means allowing actuation of the said driving means by a user; the ground-machining machine being characterized in that the maneuvering mast and the said driving means are adapted to allow the adjustment for height of the said actuation means along the said principal axis, the driving means comprises: a shaft integral with the said actuation means and extending along the said principal axis; an interface locked in translation with respect to the said bottom tube and free to rotate around the said principal axis, the said interface comprising on the one hand sliding means that cooperate with the said shaft in order to produce between them a sliding connection and on the other hand a first means forming a thread; a second means locked in rotation and forming a thread that cooperates with that of the first means in order to drive the said second means in translation; a bottom plate integral with the said second means and with a driving stud; at least one arm, one of the ends of which is mounted so as to be free to rotate on the said driving stud and the other end of which is mounted so as to be free to rotate on the main chassis.

12. Ground-machining machine according to claim 11, wherein the bottom tube comprises an aperture through which the said driving stud passes.

13. Ground-machining machine according to claim 12, wherein the said aperture has an oblong shape whose axis is parallel to the said principal axis.

14. Ground-machining machine according to claim 11, wherein the shaft comprises an internal recess whose dimensions are at least greater than the dimensions of the said second means.

15. Ground-machining machine according to claim 11, wherein the ground-machining machine comprises means of locking the top tube with respect to the bottom tube.

16. Ground-machining machine according to claim 11, wherein the ground-machining machine comprises handles integral with the maneuvering mast.

17. Ground-machining machine according to claim 16, wherein the said handles are mounted on the said maneuvering mast by means of an angular and/or lateral adjustment device.

* * * * *